US007992830B2

(12) United States Patent
Wenger

(10) Patent No.: US 7,992,830 B2
(45) Date of Patent: Aug. 9, 2011

(54) DISPLAY SUPPORT ELEMENT FOR WRISTBAND AND WRISTWATCH

(75) Inventor: Sylvain Wenger, Fournex (CH)

(73) Assignee: Technew S.A., Meyrin (CH)

( * ) Notice: Subject to any disclaimer, the term of this patent is extended or adjusted under 35 U.S.C. 154(b) by 379 days.

(21) Appl. No.: 12/278,244

(22) PCT Filed: Jan. 12, 2007

(86) PCT No.: PCT/EP2007/050287

§ 371 (c)(1),
(2), (4) Date: Oct. 8, 2008

(87) PCT Pub. No.: WO2007/088094

PCT Pub. Date: Aug. 9, 2007

(65) Prior Publication Data

US 2009/0095850 A1 Apr. 16, 2009

(30) Foreign Application Priority Data

Feb. 3, 2006 (EP) ..... 06002262

(51) Int. Cl.
*A47F 7/02* (2006.01)

(52) U.S. Cl. ..... 248/116; 248/115; 368/316

(58) Field of Classification Search ..... 248/114, 248/115, 116; 368/316, 317
See application file for complete search history.

(56) References Cited

U.S. PATENT DOCUMENTS

| | | | | |
|---|---|---|---|---|
| 4,216,858 | A * | 8/1980 | Beauchamp | 206/759 |
| 4,293,943 | A | 10/1981 | Avery et al. | |
| 4,830,181 | A * | 5/1989 | Hartman | 206/765 |
| 5,383,552 | A * | 1/1995 | Dikowitz | 206/6.1 |
| 5,873,457 | A * | 2/1999 | Madweb | 206/301 |
| D497,805 | S * | 11/2004 | Gratiot | D9/422 |
| 6,831,560 | B2 * | 12/2004 | Gresset | 340/568.2 |
| D502,338 | S * | 3/2005 | Zanghi et al. | D6/466 |
| 2002/0092781 | A1 * | 7/2002 | Au et al. | 206/6.1 |

FOREIGN PATENT DOCUMENTS

WO 02/39856 A1 5/2002

OTHER PUBLICATIONS

International Search Report issued in corresponding application PCT/EP2007/050287, completed Apr. 26, 2007 and mailed May 8, 2007.

* cited by examiner

*Primary Examiner* — Terrell McKinnon
*Assistant Examiner* — Steven M Marsh
(74) *Attorney, Agent, or Firm* — Griffin & Szipl, P.C.

(57) ABSTRACT

The invention concerns a display support element for a bracelet and/or a wristwatch comprising:

a central element for receiving a bracelet or wristband and having a longitudinal axis substantially parallel to the longitudinal axis of the wristband or bracelet, the central element being flexible along its longitudinal axis, and two lateral elements, secured to the central element so as not to hinder the flexibility thereof, the lateral elements defining, with the central element, a substantially closed volume.

6 Claims, 2 Drawing Sheets

DISPLAY SUPPORT ELEMENT FOR WRISTBAND AND WRISTWATCH

This is a National Phase Application in the United States of International Patent Application No. PCT/EP2007/050287 filed Jan. 12, 2007, which claims priority on European Patent Application No. 06002262.1, filed Feb. 3, 2006. The entire disclosures of the above patent applications are hereby incorporated by reference.

FIELD OF THE INVENTION

The invention relates to the field of display of timepieces and jewelry. It concerns more specifically a single piece display support element for a wristband or wristwatch.

BACKGROUND OF THE INVENTION

In top of the range horology, a wristwatch must be very carefully displayed in its presentation case. Generally, the wristwatch is displayed on a support arranged in a housing provided for this purpose in the presentation case.

Among known support elements, the single piece type support elements, defining a closed volume, give a particularly attractive and rich impression. These support elements may be rigid or flexible.

In their rigid version, they are formed of a single piece having a substantially oval profile, covered with velvet or leather. Because of their rigidity, these support elements cannot be adapted to different bracelet or wristband lengths. Consequently, they have to be produced in an entire range of sizes, and the housings, in the presentation cases, have to be provided with variable dimensions. This substantially complicates the use of this type of support element and increases manufacturing costs.

In their flexible version, these support elements are typically formed of a cushion, perfectly appropriate for a woman's watch, but considerably less so for a man's watch.

The present invention overcomes these drawbacks by proposing a display support element for a wristwatch, of single piece appearance, able to be adapted to women's and men's watches having different wristband lengths.

SUMMARY OF THE INVENTION

More specifically, the invention concerns a display support element for a bracelet and a wristband. According to the invention, the support element comprises:

- a central element for receiving a wristband or bracelet and having a longitudinal axis substantially parallel to the longitudinal axis of the wristband, the central element being flexible along its longitudinal axis, and
- two lateral elements, fixed to the central element so as not to hinder the flexibility of the latter, the lateral elements defining, with the central element, a substantially closed volume.

Owing to its flexibility, the central element of the support according to the invention can deform in order to fit different wristband lengths. The support keeps its single piece appearance owing to the lateral elements that remain abutting against the flanks of the central element, however the latter might deform.

BRIEF DESCRIPTION OF THE DRAWINGS

Other features and advantages of the present invention will appear more clearly from the following description of an example embodiment of the support according to the invention, this example being given purely by way of non-limiting illustration, in conjunction with the annexed drawings, in which.

DETAILED DESCRIPTION OF THE ILLUSTRATIVE EMBODIMENTS

Figure 1:
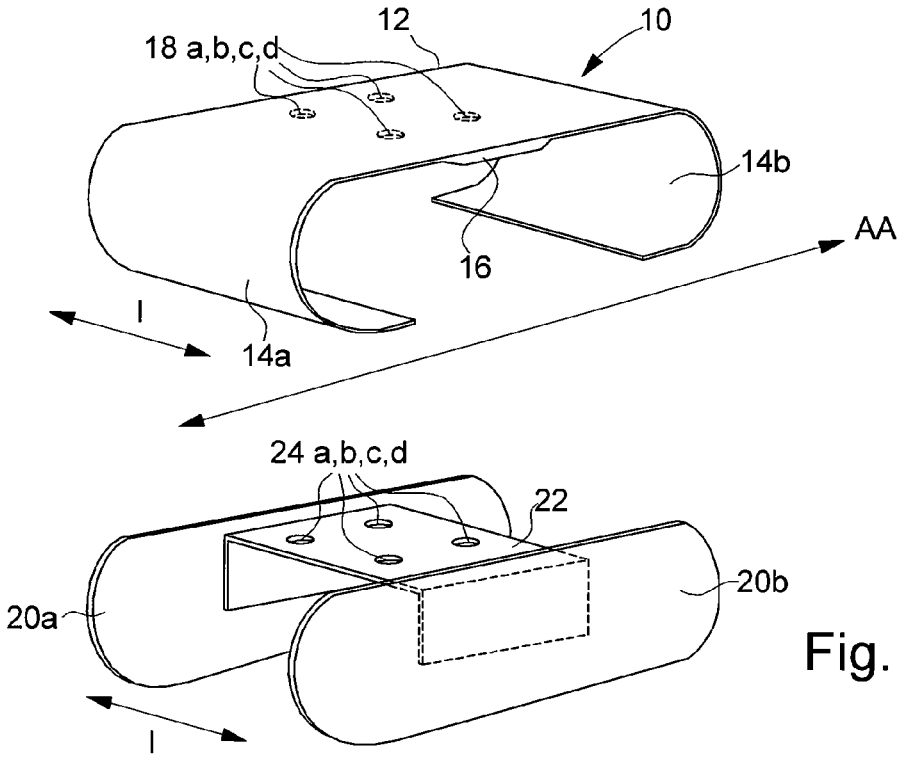
FIG. 1 is an exploded view of the display support element according to the invention.

The wristwatch support element shown in FIG. 1 comprises a central element 10 for supporting and holding a wristwatch. The central element 10 has a longitudinal axis AA substantially parallel to the longitudinal axis of the watch wristband that it carries. It is formed of a long plate facing its width 1, bent at both of its ends, and substantially forms a C comprising a median portion 12 and two curved portions 14*a* and 14*b*. The plate is formed of a resilient material, such as plastic or a metal, so as to be flexible along its longitudinal axis AA. Its median portion 12, substantially flat, comprises a reinforced part 16 towards the inside of the C, provided with four rivets 18*a, b, c* and *d*.

The wristwatch support element also comprises two lateral elements 20*a* and 20*b* formed of two rigid plates, of substantially oval shape, mounted on the sides of central element 10. The two lateral elements 20*a* and 20*b* are connected via a rigid connecting U-shaped plate 22, welded or bonded to each other, holding them parallel and separated substantially by a distance 1, the width of central element 10. The connecting plate 22 is pierced with four holes 24*a, b, c* and *d*, in which the four rivets, respectively 18*a, b, c* and *d* are forcibly mounted.

Figure 2:
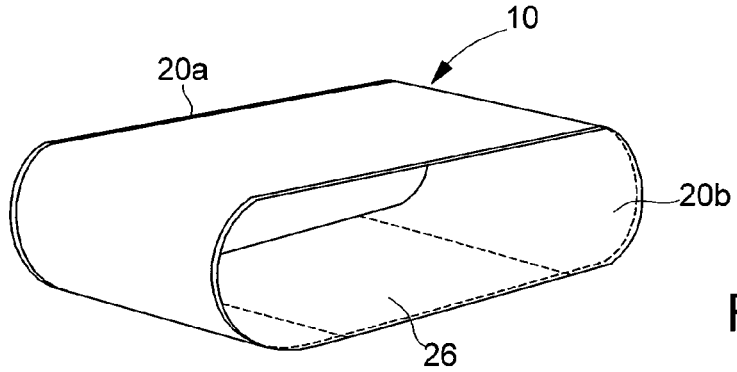
FIG. 2 is a perspective view of the same support element.

The two lateral elements 20*a* and 20*b* thus abut on the flanks of central element 10, fitting, because of their oval shape, its C-shaped profile. They define with central element 10 a substantially closed volume on all sides, with the exception of an aperture 26 located on the bottom face, not visible when the support element is placed in a presentation case or on any surface. The display support element according to the invention thus forms a support with a single piece appearance as illustrated in FIG. 2.

For aesthetic purposes, central element 10 and the lateral elements 20*a* and 20*b* can be covered with a decorative material, such as velvet or leather, such that all of the visible parts of the support are decorated.

Figure 3:
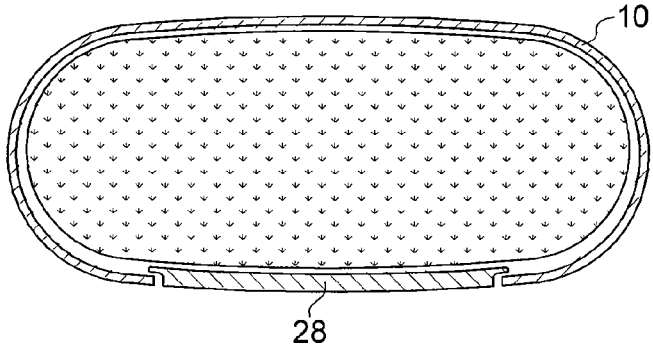
FIG. 3 is a cross-section of a particular embodiment of the support element according to the invention.

In a particularly well-finished embodiment, the presentation support element is also filled with foam or mousse through aperture 26 located on the lower face. The foam can be injected or cut so as to fit the inner volume of the support element. A resiliently deformable plate 28 then closes aperture 26 as illustrated in FIG. 3.

Figure 4A:
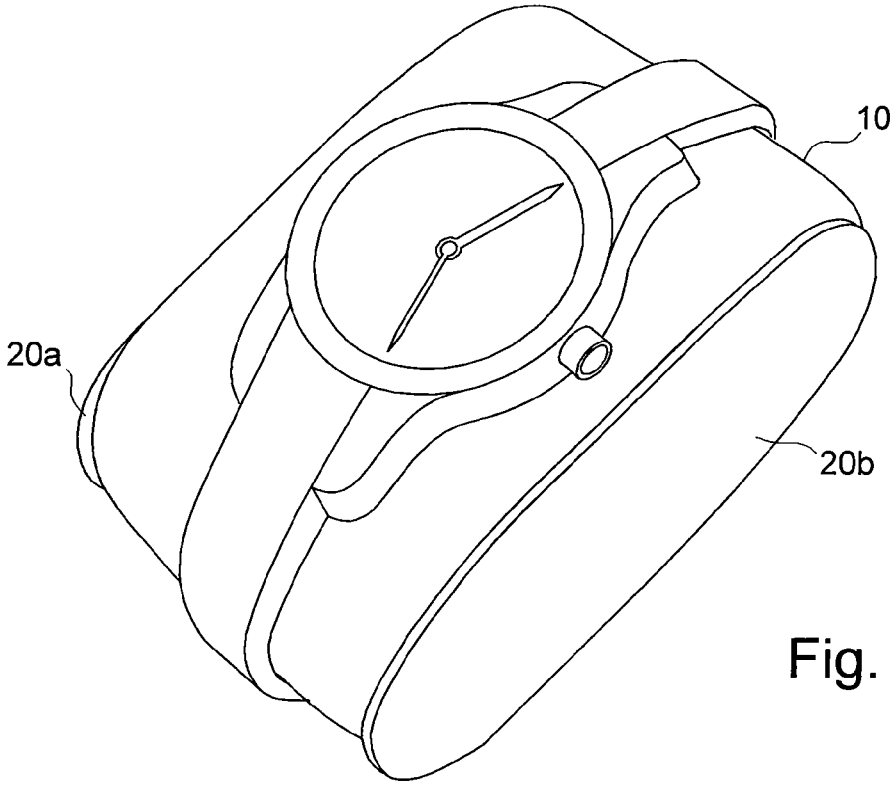
FIGS. 4*a* and 4*b* illustrate the support element according to the invention on which are mounted first and second wristwatches of different sizes.
Figure 4B:
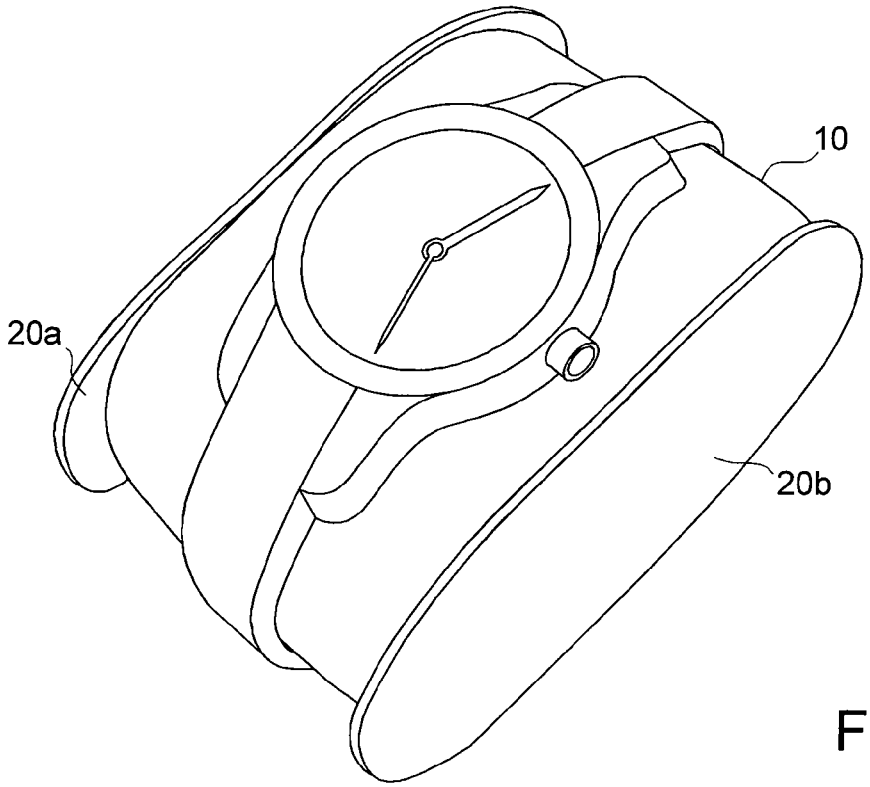

When a wristwatch is mounted on central element 10 of the support according to the invention, as illustrated in FIGS. 4*a* and 4*b*, it compresses central element 10 slightly or more strongly depending upon the length of the wristband. Central element 10 is deformed more or less, depending upon the tightening or wristband length. The watch is held in place on central element 10, which, owing to its resilience, exerts tension on the wristband.

FIG. 3*a* illustrates the support element according to the invention on which a man's watch is mounted. Central element 10 is slightly compressed. In FIG. 3*b*, a woman's watch is mounted on the support element according to the invention. The central element is compressed more strongly, and the support maintains its single piece or monobloc appearance.

In the embodiment presented hereinbefore, the lateral elements 20*a* and 20*b* are secured to each other by a connecting plate, which is itself secured to central element 10. In a variant, these lateral elements 20*a* and 20*b* are independent of each other, and individually secured to central element 10. They are, for example, welded or bonded, or fixed in a non definitive manner, via an L-shaped plate one branch of which is secured to lateral element 20*a*, 20*b* and the other branch to central element 10. Whichever method of securing is chosen, the lateral elements 20*a* and 20*b* are secured so as not to hinder the flexibility of central element 10. They are thus preferably secured over a small width, on median portion 12 of central element 10.

The invention claimed is:

1. A display support element for a wristband and/or a wristwatch, the display support element including:

a central element for receiving a wristband, wherein the central element has a longitudinal axis substantially parallel to a longitudinal axis of the wristband, and the central element is flexible along the longitudinal axis thereof; and two lateral elements that are secured to the central element so as not to hinder flexibility of the central element, wherein the two lateral elements define, with the central element, a closed volume, and shape of each lateral element corresponds to a profile of the central element, wherein the central element is formed of a plate of resilient material including a substantially flat median portion and two curved portions so as to form substantially a C, and wherein the two lateral elements are formed of a flat substantially oval plate.

2. The support element according to claim 1, wherein said lateral elements are secured to each other via a U-shaped connecting plate, whose length is equal to the width of said central element, said connecting plate being secured to said median part of said central element.

3. The support element according to claim 2, wherein said median portion is provided with rivets oriented towards the inside of the C, and wherein said connecting plate is pierced with holes, said rivets being forcibly mounted in said holes.

4. The support element according to claim 1, wherein said central element and said lateral elements are further covered with a decorative covering.

5. The support element according to claim 1, wherein said support element is filled with foam.

6. The support element according to claim 1, wherein said volume defined by said central element and said lateral elements is closed by a plate that can deform resiliently.

* * * * *